United States Patent [19]

Cavallo et al.

[11] Patent Number: 4,975,363

[45] Date of Patent: Dec. 4, 1990

[54] LIGHT-SENSITIVE SILVER HALIDE PHOTOGRAPHIC MATERIALS

[75] Inventors: Elio Cavallo; Renzo Torterolo, both of Savona, Italy

[73] Assignee: Minnesota Mining and Manufacturing Company, St. Paul, Minn.

[21] Appl. No.: 431,443

[22] Filed: Nov. 3, 1989

[30] Foreign Application Priority Data

Nov. 25, 1988 [IT] Italy ..... 22737 A/88

[51] Int. Cl.[5] ..... G03C 1/494; G03C 1/85; G03C 1/76

[52] U.S. Cl. ..... 430/637; 430/627; 430/631; 430/635; 430/636; 430/523; 430/529; 430/950

[58] Field of Search ..... 430/950, 529, 637, 523, 430/627, 631, 635, 636, 637

[56] References Cited

U.S. PATENT DOCUMENTS

| | | | |
|---|---|---|---|
| 3,754,924 | 8/1973 | DeGeest et al. | 430/635 |
| 3,884,699 | 5/1975 | Cavallo et al. | 96/87 |
| 4,013,696 | 3/1977 | Babbitt et al. | 428/412 |
| 4,232,117 | 11/1980 | Naoi et al. | 430/950 |
| 4,266,010 | 5/1981 | Nagatomo et al. | 430/950 |
| 4,367,283 | 1/1983 | Nakayama et al. | 430/528 |
| 4,596,766 | 6/1986 | Nemori et al. | 430/527 |
| 4,649,102 | 3/1987 | Mukunoki et al. | 430/637 |
| 4,675,278 | 6/1987 | Sugimoto et al. | 430/523 |
| 4,847,187 | 7/1989 | Ono et al. | 430/636 |

FOREIGN PATENT DOCUMENTS

| | | | |
|---|---|---|---|
| 59-74554 | 4/1984 | Japan | 430/529 |
| 63-5339 | 1/1988 | Japan | 430/529 |
| 1496534 | 12/1977 | United Kingdom . | |

*Primary Examiner*—Paul R. Michl
*Assistant Examiner*—Ashley I. Pezzner
*Attorney, Agent, or Firm*—Donald M. Sell; Walter N. Kirn; Donald M. Sell

[57] ABSTRACT

Light-sensitive silver halide photographic materials comprising a support base and one or more hydrophilic colloid layers, at least one of which is a silver halide emulsion layer, at least one hydrophilic colloid surface layer of said photographic materials containing (a) a non-ionic surface active agent having a polyoxyethylene group, (b) a fluorinated organic compound which is the reaction product of a polyoxyalkyleneamine compound and a fluorinated organic acid compound, (c) discrete particles of a water-insoluble matting agent and (d) discrete particles of a water-insoluble surface modifying agent selected in the group of a silicone polymer and colloidal silica.

15 Claims, No Drawings

LIGHT-SENSITIVE SILVER HALIDE PHOTOGRAPHIC MATERIALS

FIELD OF THE INVENTION

The present invention relates to light-sensitive silver halide photographic materials and, more in particular, to light-sensitive silver halide photographic materials having excellent antistatic properties obtained by incorporation of a non-ionic surface active agent, a fluorinated organic salt compound, discrete particles of a water-insoluble matting agent and discrete particles of a water-insoluble surface modifying agent selected in the group of a silicone polymer and colloidal silica, in at least one hydrophilic colloid layer of said photographic materials.

BACKGROUND OF THE ART

Light-sensitive photographic materials generally comprise a support and coated on one or both sides thereof hydrophilic colloid layers including a light-sensitive silver halide emulsion layer (or layers) and, if desired or necessary, other non light-sensitive layers such as subbing layers, intermediate layers, protective layers, backing layers, antihalation layers and the like. Examples of supports include films of a poly-α-olefin (such as polyethylene, polystyrene, etc.), a polyester (such as polyethyleneterephthalate, etc.), a cellulose ester (such as cellulose triacetate, etc.), paper, synthetic paper or resin-coated paper and the like.

Since the support of a light-sensitive photographic material has electrical insulating properties, static charges are frequently generated during production and use of said photographic material due to contact friction and separation between surfaces of the same kind of materials or surfaces of different kinds of materials. The accumulated static charges may cause various problems. For example, the accumulated static charges may discharge before development of the photographic material and generate light to which the silver halides are sensitive; after development of the photographic material, dot-like marks (called positive static marks) and branch-like marks (called negative static marks) are formed. Said static marks negatively affect the photographic images, particularly X-ray materials for medical and industrial use where static marks may lead to a dangerous misreading. Additionally, the accumulated static charges may attract dust or other particles on the surface of the support negatively affecting the quality during the coating step.

Static charges are, in general, related to the surface resistivity and charge level. Therefore, the accumulation of static charges can be prevented by reducing the surface resistivity or by lowering the charge level.

The surface resistivity of a layer is reduced by addition to the layer of substances which increase the electrical conductivity and release the accumulated electrical charges in a very short time before discharge. In the art, various processes have been disclosed for improving the electrical conductivity of supports and surface layers of photographic materials, and many hygroscopic substances, water soluble inorganic salts, surface active agents, polymers and the like have been suggested to such purpose. For example, polymers as described in U.S. Pat. Nos. 2,822,157, 2,861,056, 2,972,535, 3,062,785, 3,169,949, 3,260,706, 3,262,807, 3,514,291, 3,589,908, 3,607,286, 3,615,531, etc., surface active agents as described in GB Pat. Nos. 861,134, 1,285,647, 1,259,398, 1,330,356, etc., in U.S. Pat. Nos. 2,982,651, 3,428,456, 3,457,076, 3,454,652, 3,552,972, 3,589,906, 3,640,748, 3,655,387, etc., nitrates, metal oxides, semiconductors, colloidal silica or colloidal alumina, etc., as described in GB Pat. No. 2,075,208, in U.S. Pat. Nos. 3,062,700, 3,254,833, 3,525,621, 4,264,707, etc., have been proposed for this purpose. Among said substances, non-ionic surfactants having polyoxyethylene chains have been described as having excellent antistatic properties.

Another method to prevent accumulation of static charges is that of lowering the charge level by controlling the triboelectric charge generated on the surface of photographic materials to reduce generation caused by friction and separation of surfaces, as described for example in U.S. Pat. No. 3,888,678. According to this method, fluorine containing compounds, surface active agents, polymers, etc. have been disclosed as substances to reduce static charges. Particularly, fluorine containing surface active agents have been described, for the above purposes, for example in the above mentioned U.S. patent, in GB Pat. Nos. 1,330,356 and 1,524,631, in GB patent application No. 2,096,782, in U.S. Pat. Nos. 3,666,478, 3,589,906, 3,884,699 and 4,330,618, in JA Pat. No. 26687/77 and in JA Pat. applications No.46733/74 and 32322/76.

However, for preventing the accumulation of electric charges, it is difficult to select a single antistatic agent owing to the different kinds of supports, coating compositions and surfaces of materials which are to be considered. Therefore, methods have been described for improving the characteristics of static chargeability of photographic materials, such as those described for example in U.S. Pat. No. 3,884,699 (use of a fluorinated cationic or anionic surfactant in combination with a non-fluorinated betaine surfactant and/or a N-oxide surfactant), GB Pat. No. 1,496,534 (use of organic fluorinated compounds in combination with carboxy group-containing organic compounds), U.S. Pat. No. 4,013,696 (use of cationic fluorinated alkyl surfactants in combination with non-ionic alkylphenoxypolypropyleneoxide surfactants), U.S. Pat. No. 4,367,283 (use of non-ionic surfactants having a polyoxyethylene group in combination with anionic surfactants and fluorinated anionic surfactants) and U.S. Pat. No. 4,596,766 (use of a non-ionic surfactant having a polyoxyethylene group in combination with a fluorinated organic compound in a surface layer having a specific amount of said fluorinated compound).

In spite of the numerous methods and compounds described for increasing electrical conductivity and lowering charge level, the production of photographic materials exhibiting a reduced static chargeability is very difficult. Problems are encountered with insufficient reduction in surface resistivity at low humidities, with the contact between the surfaces of the photographic material itself or between such material and other material surfaces at high temperatures and humidities. Such problems become more severe as the sensitivity of the photographic material is higher and the processing speed is increased (such as when the photographic material is used in rapid processing machines where the film is conveyed at a high speed by means of rollers or other surfaces which exert thereon a strong pressure and friction action). On the other hand, compounds which have good antistatic properties, cannot often be used because they negatively affect the photographic properties (such as sensitivity, fog, contrast), image quality (such as graininess, sharpness), the performance of processing chemistries where said antistatic compounds may accumulate, the coating quality, etc., or lose their antistatic ability over a period of time during storage of the photographic material.

Accordingly, the application of antistatic compounds to light-sensitive photographic materials is very difficult and there is a continuous need for providing improved antistatic compositions which do not adversely affect the other characteristics of the material.

SUMMARY OF THE INVENTION

According to the present invention, the use of (a) a non-ionic surface active agent having a polyoxyalkylene group, (b) a fluorinated organic salt which is the reaction product of a polyoxyalkyleneamine compound with a fluorinated organic acid compound, (c) discrete particles of a water-insoluble matting agent and (d) discrete particles of a water-insoluble surface modifying agent, selected in the group of a silicone polymer and colloidal silica, in a hydrophilic colloidal surface layer of a light-sensitive silver halide photographic material has been found to allow the static chargeability on the photographic material surface to be reduced without negatively affecting the photographic characteristics of said photographic material.

The photographic materials comprising the unique combination of the present invention in a surface layer thereof are suitable to be processed in high-speed transport automatic processors without any drawback caused by static charge accumulation occurring thereon.

DETAILED DESCRIPTION OF THE INVENTION

The present invention refers to a light-sensitive photographic material comprising a support base and at least one or more hydrophilic colloidal layers, at least one of which is a silver halide emulsion layer, at least one hydrophilic colloidal surface layer of said material containing (a) a non-ionic surface active agent having a polyoxyalkylene group, (b) a fluorinated organic salt which is the reaction product of a polyoxyalkyleneamine compound with a fluorinated organic acid compound, (c) discrete particles of a water-insoluble matting agent and (d) discrete particles of a water-insoluble surface modifying agent selected in the group of a silicone polymer and colloidal silica.

In the present invention, polyoxyalkyleneamine compounds, used to obtain the fluorinated organic compounds, contain amino groups, preferably primary amino groups, attached to the end of a polyoxyalkylene chain. The polyoxyalkylene chain is based either on propylene oxide, ethylene oxide or mixed ethylene/propylene oxide. The polyoxyalkyleneamine compounds comprise monoamine, diamine and triamine compounds with molecular weights ranging from about 200 to about 6,000. Particularly representative polyoxyalkyleneamine compounds are those represented by the following general formulas from (I) to (V):

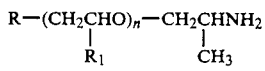

(I)

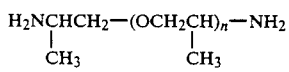

(II)

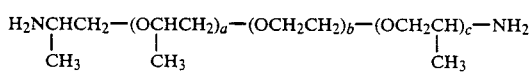

(III)

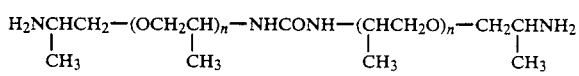

(IV)

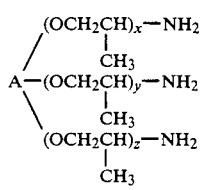

(V)

wherein R represents an alkoxy group which may be substituted, preferably a lower alkoxy group having 1 to 5 carbon atoms, such as methoxy, ethoxy, propoxy, 2-methoxy-ethoxy, etc., $R_1$ represents a hydrogen atom or a methyl group, n represents an integer of 1 to 50, b represents an integer of 5 to 150, a and c, the same or different, each represent an integer from 0 to 5, such that a+c represents an integer from 2 to 5, A represents a $CH\equiv$, $CH_3C\equiv$, $CH_3CH_2C\equiv$, or a $-CH_2-CH-CH_2-$group and x, y and z, equal or different, represent integers of 1 to 30.

Examples of polyoxyalkyleneamine compounds useful to obtain fluorinated organic compounds according to this invention are illustrated below.

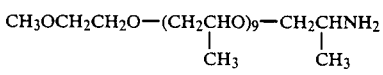

(A-1)

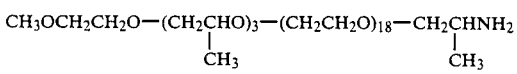

(A-2)

-continued $$H_2NCHCH_2-(OCH_2\underset{\underset{CH_3}{|}}{CH})_{2-3}-NH_2 \quad \text{(A-3)}$$
$$\quad CH_3$$

$$H_2N\underset{\underset{CH_3}{|}}{CH}CH_2-(OCH_2\underset{\underset{CH_3}{|}}{CH})_{5-6}-NH_2 \quad \text{(A-4)}$$

$$H_2N\underset{\underset{CH_3}{|}}{CH}CH_2-(O\underset{\underset{CH_3}{|}}{CH}CH_2)_a-(OCH_2CH_2)_b-(OCH_2\underset{\underset{CH_3}{|}}{CH})_c-NH_2 \quad \text{(A-5)}$$

wherein b is ~8.5 and a + c is ~2.5

$$H_2N\underset{\underset{CH_3}{|}}{CH}CH_2-(O\underset{\underset{CH_3}{|}}{CH}CH_2)_a-(OCH_2CH_2)_b-(OCH_2\underset{\underset{CH_3}{|}}{CH})_c-NH_2 \quad \text{(A-6)}$$

wherein b is ~15.5 and a + c is ~2.5

$$H_2N\underset{\underset{CH_3}{|}}{CH}CH_2-(OCH_2\underset{\underset{CH_3}{|}}{CH})_{5-6}-NHCONH-(\underset{\underset{CH_3}{|}}{CH}CH_2O)_{5-6}-CH_2\underset{\underset{CH_3}{|}}{CH}NH_2 \quad \text{(A-7)}$$

$$H_2N\underset{\underset{CH_3}{|}}{CH}CH_2-(OCH_2\underset{\underset{CH_3}{|}}{CH})_{33}-NHCONH-(\underset{\underset{CH_3}{|}}{CH}CH_2O)_{33}-CH_2\underset{\underset{CH_3}{|}}{CH}NH_2 \quad \text{(A-8)}$$

$$\begin{array}{l} \quad (OCH_2\underset{\underset{CH_3}{|}}{CH})_y-NH_2 \\ HC-(OCH_2\underset{\underset{CH_3}{|}}{CH})_x-NH_2 \\ \quad (OCH_2\underset{\underset{CH_3}{|}}{CH})_z-NH_2 \end{array} \quad \text{wherein } x + y + z \sim 5.6 \quad \text{(A-9)}$$

$$\begin{array}{l} H_2C-(OCH_2\underset{\underset{CH_3}{|}}{CH})_x-NH_2 \\ HC-(OCH_2\underset{\underset{CH_3}{|}}{CH})_y-NH_2 \\ H_2C-(OCH_2\underset{\underset{CH_3}{|}}{CH})_z-NH_2 \end{array} \quad \text{wherein } x + y + z \sim 30 \quad \text{(A-10)}$$

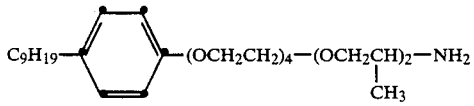

(A-11)

Polyoxyalkyleneamine compounds are commercially available with the name of Jeffamine TM Polyoxyalkyleneamines manufactured by Texaco Chemical Company.

Preferably, fluorinated organic acid compounds, suitable to react with polyoxyalkyleneamine compounds, are perfluoroalkylsulfonic acid compounds. Suitable perfluoroalkylsulfonic acid compounds are represented by the following general formula:

$$\{R_f(B)_o\}\text{-}(SO_3H)_p \quad \text{(VI)}$$

wherein $R_f$ represents an unsubstituted or substituted alkyl group having 2 to 18 carbon atoms, preferably 5 to 10 carbon atoms, or an unsubstituted or substituted alkenyl group having 2 to 15 carbon atoms, preferably 4 to 8 carbon atoms in which the hydrogen atoms are partially or completely substituted with fluorine atoms to include at least 3 fluorine atoms, B represents a divalent organic group, o represents 0 or 1 and p represents 1 or 2. B preferably represents a carbonyl, a sulfonyl, an amino, an alkylene group preferably having 1 to 3 carbon atoms, an arylene group (such as phenylene or naphthylene), an oxygen atom or groups consisting of two or more of the above-mentioned groups, such as for instance carbonylamino, sulfonylamino, aminocarbonyl, aminosulfonyl, ester or polyoxyalkylene groups preferably containing 2 to 40 oxyalkylene unities.

Examples of perfluoroalkylsulfonic acids are illustrated below.

$$C_8F_{17}-SO_3H \quad \text{(B-1)}$$

$$C_8F_{17}-\underset{\underset{C_3H_7}{|}}{N}-CH_2SO_3H \quad \text{(B-2)}$$

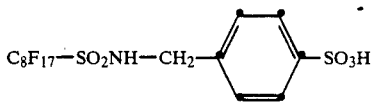

(B-3)

$$H-(CF_2)_6-COOCH_2CH_2CH_2-SO_3H \quad \text{(B-4)}$$

-continued

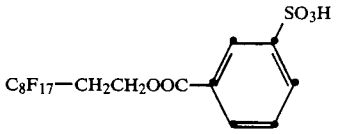

(B-5)

$C_7F_{15}-CON(CH_3)-CH_2CH_2SO_3H$ (B-6)

$H-(CF_2)_6-CH_2OOC-CH_2$
$H-(CF_2)_6-CH_2OOC-CH(SO_3H)$ (B-7)

$H-(CF_2)_8-CH_2O-(CH_2CH_2O)_3-OC-CH_2$
$H-(CF_2)_8-CH_2O-(CH_2CH_2O)_3-OC-CH(SO_3H)$ (B-8)

$C_8F_{17}SO_2N(C_3H_7)-(CH_2CH_2O)_4-(CH_2)_4-SO_3H$ (B-9)

$C_{16}H_{33}-CH(SO_3H)-CONH-(CF_2)_3-H$ (B-10)

$C_8F_{17}SO_2N(C_3H_7)-CH_2CH_2OSO_3H$ (B-11)

-continued $C_6H_{13}O-OC-CH_2$
$C_8F_{17}CH_2CH_2O-OC-CH(SO_3H)$ (B-12)

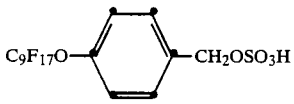

(B-13)

$HO_3S-(CF_2)_4-SO_3H$ (B-14)

$C_4F_9-SO_3H$ (B-15)
$C_7F_{15}-SO_3H$ (B-16)

The above listed perfluoroalkylsulfonic acid compounds can be found on the market or prepared in a conventional way.

The fluorinated organic salt compounds according to the present invention can be prepared by direct reaction of the above described polyoxyalkyleneamine compounds with the above described flourinated organic acid compounds, preferably in the presence of a low-boiling organic solvent, e.g. methanol, ethanol, acetone, and the like, and separating the fluorinated organic salt compound with techniques known in the art.

Examples of fluorinated organic salt compounds suitable to the purpose of the present invention are illustrated below.

$H_3C-CH(CH_3)-NH_2.C_8F_{17}SO_3H$
$CH_2-(OCH(CH_3)CH_2)_a-(OCH_2CH_2)_b-(OCH_2CH(CH_3))_cNH_2.C_8F_{17}SO_3H$ (1)

(wherein b = 8.5 and a + c = 2.5)

$H_3C-CH(CH_3)-NH_2.C_4F_9SO_3H$ $HO_3SF_9C_4.H_2N-CH(CH_3)-CH_3$
$CH_2-(OCH(CH_3)CH_2)_a-(OCH_2CH_2)_b-(OCH_2CH(CH_3))_c-CH_2$ (2)

(wherein b = 15.5 and a + c = 2.5)

$H_3C-CH(CH_3)-NH_2.C_7F_{15}SO_3H$ $HO_3SF_{15}C_7.H_2N-CH(CH_3)-CH_3$
$CH_2-(OCH(CH_3)CH_2)_a-(OCH_2CH_2)_b-(OCH_2CH(CH_3))_c-CH_2$ (3)

(wherein b = 40.5 and a + c = 2.5)

$CH_3OCH_2CH_2O-(CH_2CH(CH_3)O)_9-CH_2CH(CH_3)NH_2.C_8F_{17}SO_3H$ (4)

$CH_3OCH_2CH_2O-(CH_2CH(CH_3)O)_9-CH_2CH(CH_3)NH_2.C_8F_{17}-N(C_3H_7)-CH_2SO_3H$ (5)

$CH_3OCH_2CH_2O-(CH_2CH(CH_3)O)_9-CH_2CH(CH_3)NH_2.HO_3S$
$(CF_2)_4$
$CH_3OCH_2CH_2O-(CH_2CH(CH_3)O)_9-CH_2CH(CH_3)NH_2.HO_3S$ (6)

-continued

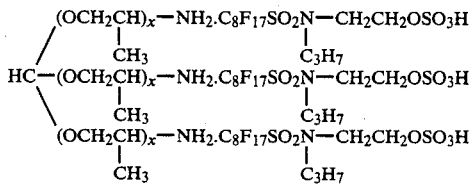

(7)

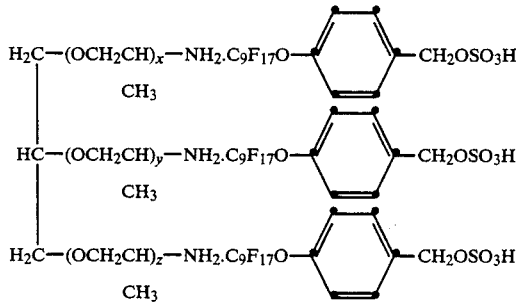

(8)

(wherein x + y + z = ~30).

Non-ionic surface active agents, for use in the present invention in combination with fluorinated organic salt compounds, are described, for example in British Pat. No. 861,134, in U.S. Pat. Nos. 2,982,651, 3,428,456, 3,457,076, 3,454,625, 3,552,927, 3,655,387, 3,850,641, 4,367,283, 4,518,354, 4,596,766 and in Japanese Pat. Publication No. 208,743/83.

In the present invention, non-ionic surface active agents having a polyoxyalkylene chain represented by the following general formula (VII) are particularly effective as non-ionic surface active agents:

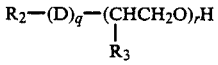

(VII)

wherein $R_2$ represents an unsubstituted or substituted alkyl group having 1 to 30 carbon atoms, an unsubstituted or substituted alkenyl group having 1 to 30 carbon atoms or an unsubstituted or substituted aryl group (such as phenyl or naphthyl), $R_3$ represents a hydrogen atom or a methyl group, D represents a group —O—, —S—, —COO—,

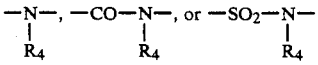

wherein $R_4$ represents a hydrogen atom or an unsubstituted or substituted alkyl group having 1 to 12 carbon atoms, q represents 0 or 1 and r represents an integer of 2 to 50.

Examples of non-ionic polyoxyalkylene surface active agents which are preferably used in combination with fluorinated organic salt compounds according to this invention are illustrated below.

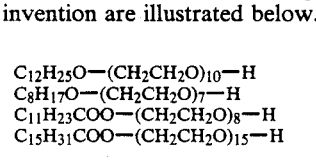

$C_{12}H_{25}O—(CH_2CH_2O)_{10}—H$ (9)
$C_8H_{17}O—(CH_2CH_2O)_7—H$ (10)
$C_{11}H_{23}COO—(CH_2CH_2O)_8—H$ (11)
$C_{15}H_{31}COO—(CH_2CH_2O)_{15}—H$ (12)

-continued

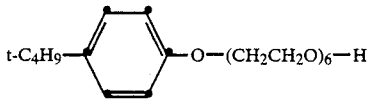

(13)

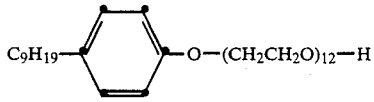

(14)

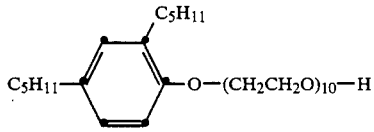

(15)

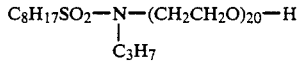

(16)

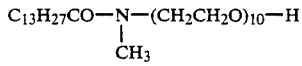

(17)

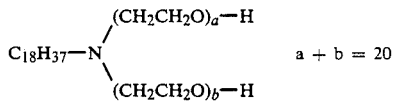

(18)

(19)

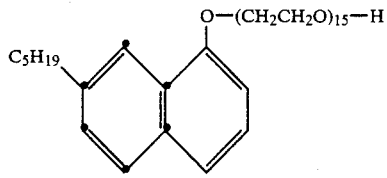

(20)

The water-insoluble matting agents to be used in the present invention can be either inorganic or organic compounds. Examples of useful matting agents comprise titanium dioxide, magnesium oxide, alluminium oxide, starch, barium sulfate, cellulose esters, such as cellulose propionate acetate, cellulose ethers such as ethyl-cellulose, synthetic resins such as acrylic and methacrylic acid esters, polyvinyl resins such as polyvinylacetate, polycarbonates, styrene homopolymers and copolymers, and the like. The matting agent most preferred to the purposes of the present invention is polymethylmethacrylate. Matting agents are incorporated into the layer under the form of small particles uniformly dispersed therein having an average diameter preferably in the range from 3 to 6 μm. They may be either directly dispersed in the layer or may be dispersed in water solutions or in the water dispersions of the layer binding material and then added to the coating composition prior to coating itself. Examples of matting agents and methods for the preparation and introduction of the matting agents into the layer are described for example in U.S. Pat. Nos. 2,322,037, 3,701,245, 3,411,907 and 3,754,924.

The surface modifying agents to be used in the present invention are selected in the class consisting of silicone polymers and colloidal silica.

Preferred examples of silicone polymers are those represented by general formula:

(VIII)

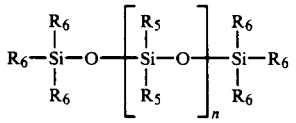

wherein $R_5$ is an alkyl group having 1 to 3 carbon atoms, $R_6$ is an alkyl group having 1 to 3 carbon atoms or an alkoxy group having 1 to 2 carbon atoms and n is a positive integer from 0 to 2000.

Useful silicone polymers include silicon oils which can be found on the market such as dialkylpolyisyloxanes with alkyl or alkoxy group terminated, e.g. dimethylpolyisyloxane, diethylpolyisyloxane, trimethoxydimethylpolyisyloxane and triethoxydimethylpolyisyloxane. Silicone polymers are generally added to the coating composition which is used to form the surface layer of the photographic material under the form of dispersions in water or in water solutions of the layer binding material. Examples of silicone polymers and methods for the preparation of the silicone polymer dispersions and for the introduction thereof into the photographic layers are described, for instance, in GB Pat. Nos. 955,061 and 1,417,915.

Colloidal silica are colloidal water dispersions of very small silica particles which can be directly added to the coating composition which is used to form the surface layer of the photographic material according to the present invention. Silica particles result to be small discrete spheres uniformly dispersed in water alkaline media which react with the silica surface to produce a negative charge. Due to the negative charge, the particles repel each other thus making up a stable water dispersion. Colloidal silica are available on the market under the name of Ludox TM colloidal silica produced by DuPont Company.

The particles of the surface modifying agent of the present invention, silicone polymers or colloidal silica, result to be uniformly dispersed in the layer with average diameters preferably in the range from 0.001 to 1 μm.

The light-sensitive silver halide photographic materials of the present invention, comprising the above described compounds in a surface hydrophilic colloidal layer thereof, when used in practice in automatic processors where they are transported at high speed and come into contact with different surfaces, result to have a better control of the static charge type, i.e. they tend to be charged positively rather than negatively under different use conditions, a reduction of the charge quantity accumulated on the surface, a reduction of the contact surface with other materials and a decrease of slipperiness due to an increase of the friction coefficient. Therefore, the defects caused by static electricity discharges during the preparation and use of photographic materials, above all of materials for radiographic use, are substantially reduced.

In particular, the improved light-sensitive photographic materials of the present invention comprise:

(a) a support base, (b) at least one hydrophilic colloidal silver halide emulsion layer, (c) at least one hydrophilic colloidal protective layer for said emulsion layer, and (optionally)

(d) at least one hydrophilic colloidal backing layer, the improvement consisting in that at least one of the protective and backing hydrophilic colloidal layers, preferably both layers, comprises a non-ionic surface active agent, the fluorinated organic salt, the discrete particles of a water-insoluble matting agent and the discrete particles of a water-insoluble surface modifying agent selected in the group of silicone polymers and colloidal silica, as defined above.

More in particular, the improved light-sensitive photographic material is a radiographic material comprising:

(a) a support base, (b) at least one hydrophilic colloidal silver halide emulsion layer coated on both sides of said support base, and (c) a hydrophilic colloidal protective layer coated on each emulsion layer, the improvement consisting in that at least one hydrophilic colloidal protective layer, preferably both protective layers, contain a non-ionic surface active agent, the fluorinated organic salt, the discrete particles of a water-insoluble matting agent and the discrete particles of a water-insoluble surface modifying agent selected in the group of silicone polymers and colloidal silica, as defined above.

Still more in particular, the improved light-sensitive photographic material is a radiographic material comprising:

(a) a support base, (b) at least one hydrophilic colloidal silver halide emulsion layer coated on both sides of said support base, and (c) a hydrophilic colloidal protective layer coated on each emulsion layer, the improvement consisting in that at least one hydrophilic colloidal protective layer, preferably both protective layers, comprises a non-ionic surface active agent, the fluorinated organic salt, the discrete particles of a water-insoluble matting agent and the discrete particles of a water-insoluble surface modifying agent selected in the group of silicone polymers and colloidal silica, as defined above, and at least one hydrophilic colloidal silver halide emulsion layer, preferably both hydrophilic colloidal silver halide emulsion layers, comprise the non-ionic surface active agent and the fluorinated organic salt, as defined above.

The non-ionic surface active agents, the fluorinated organic salts, the matting agents and the surface modifying agents are used in amounts sufficient to provide an antistatic effect. A preferred amount of non-ionic surface active agents ranges from about 10 to about 1000 mg/m$^2$, a more preferred amount ranges from about 50 to about 200 mg/m$^2$A preferred amount of fluorinated organic salts ranges from about 0.5 to about 1000 mg/m$^2$, a more preferred amount ranges from about 2.5 to about 500 mg/m$^2$. A preferred amount of matting agents ranges from about 5 to about 2000 mg/m$^2$, a more preferred amount ranges from about 50 to about 1000 mg/m$^2$. A preferred amount of surface modifying agents ranges from about 5 to about 5000 mg/m$^2$, a more preferred amount ranges from about 50 to about 2000 mg/m$^2$. Of course, said ranges will vary depending upon the support base which is used, the photographic composition, the manufacturing process and the use of the photographic material. The non-ionic surface active agents and the fluorinated organic salts above can be introduced into the hydrophilic colloid composition, forming upon coating the photographic layers, in the form of solutions, as known to those skilled in the art. The solvents preferably used are water, alcohol and acetone or mixture thereof or any other solvent, provided that it causes no damage to the photographic emulsion. Matting agents and surface modifying agents can be introduced into the hydrophilic colloidal composition, forming upon coating the photographic layer, under the form of water dispersions containing them as small particles, as said before.

The photographic layers of the present invention comprise or essentially consist of hydrophilic colloidal binder. Such hydrophilic colloidal binder preferably is gelatin or any other film-forming binder permeable to the conventional processing baths for photographic materials alone or mixed with gelatin.

Such hydrophilic binder can contain dispersed hydrophobic polymer particles to improve the physical characteristics of the layers. Particles of this type consist for instance of polyethylacrylate obtained for instance in the form of a latex.

Such layers can be hardened with hardeners known to those skilled in the art, such as for example formaldehyde, glyoxal, succinaldehyde, glutaraldehyde, resorcynaldehyde, mucochloric acid, epoxides, divinylsulfones used alone or in association and can contain any other coating materials known to those skilled in the art.

In the case of photographic emulsions, the layers will contain dispersed silver halides, such as for instance bromide, iodide and chloride or mixtures thereof and antifog compounds and stabilizers in association therewith. The silver halides can be chemically and spectrally sensitized, as known in the art. In the case of color emulsions, such layers can also contain couplers which upon color development with p-phenylenediamines give rise to yellow, magenta and cyan dyes, as described for instance in C.E. Kenneth Mees and T.H. James, "The Theory of the Photographic Process", 3rd edition. Said emulsion layers can contain anionic non-fluorinated surface active agents, preferably in a quantity ranging from 10 to 1000 mg/m$^2$, more preferably from 50 to 200 mg/m$^2$.

The present invention is now illustrated in more detail making reference to the following example.

EXAMPLE 1

A control photographic material (Film A) was prepared by blending three different silver iodo-bromide emulsions in order to obtain the desired sensitometric curve. The three emulsions had a silver iodide mole percent of 1.9, 2.2 and 1.5, an average grain size of 1.35, 0.65 and 0.4 μm and were blended at the percentage of 19%, 48% and 33%, respectively, based on the silver content of each. This emulsion blend was added with the coating finals, a green spectral sensitizing dye and 2.4 g per mole of silver of Hostapur TM SAS 93 (an anionic surfactant of the alkane sulfonate sodium salt type, manufactured by Hoechst AG). The emulsion blend was coated on both sides of a polyethylene terephthalate transparent base at a total silver coating weight of 5.1 g/m$^2$. On each emulsion layer was applied a gelatin protective coating having a dry thickness of 0.9 μm. This protective layer was prepared from a solution of gelatin to which were added polymethylmethacrylate (PMMA) beads as matting agent, having particle mean size of 4.5 μm, Tergitol TM 4 (an anionic surfactant corresponding to the formula:

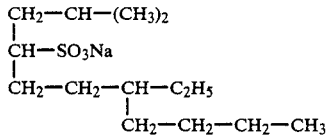

manufactured by Union Carbide Co.), Tegobetaine TM L7 (a betaine surfactant corresponding to the formula:

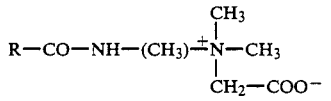

wherein R is an alyky chain having from 12 to 17 carbon atoms, manufactured by Th. Goldschmidt AG), Compound A (a cationic fluorinated compound of formula:

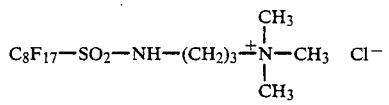

produced by 3M Company) and a hardening agent.

A radiographic material according to the present invention (Film B) was prepared in the same way as the material described above, but (a) each emulsion layer instead of Hostapur TM NPX (a non-ionic surfactant of the nonylphenylpolyethyleneglycol-ether type manufactured by Union Carbide Co.) and 0.08 g per mole of silver of Compound 1 (a fluorinated salt corresponding to the formula:

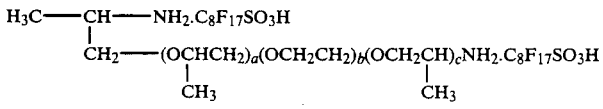

wherein b=8.5 and a+c=2.5) and (b) each protective coating comprised PMMA beads having particle mean size of 4.5 μm, Tergitol TM NPX, Compound 1 and polydimethylxiloxane SS 96/100 manufactured by Dow Corning Corporation having particle mean size of 0.2 μm.

The following Table 1 reports the composition of each protective layer. Numbers indicate grams per each gram of gelatin.

TABLE 1

| | Film A | Film B |
|---|---|---|
| Gelatin | 1.0 | 1.0 |
| PMMA | 0.054 | 0.044 |
| Tergitol TM 4 | 0.03 | — |
| Tergitol TM NPX | — | 0.027 |
| Tegobetaine TM L7 | 0.04 | — |
| Compound A | 0.0027 | — |
| Compound 1 | — | 0.007 |
| Polydimethylxiloxane | — | 0.034 |

Samples of both films were stored for 15 hours at 50° C. and then used in three different Thoramat TM Rapid Film Changers manufactured by Siemens. After the film had passed in the apparatus, the electric charge present on the film was measured by collecting the film itself in a Faraday cage and measuring the electric charge with an electrometer. Other samples of both films were passed in the three apparatus above, processed in a standard processing for x-ray films for 90" and submitted to an evaluation of the static mark presence by adopting a scholastic rate scale, where 10 is the best (absence of static marks), 1 is the worst (static marks on the whole surface) and intermediate values represent intermediate situations.

The following Table 2 reports the results obtained with the samples corresponding to the films.

TABLE 2

| | Charge amount KV/m | | | Static marks | | |
|---|---|---|---|---|---|---|
| | 1 | 2 | 3 | 1 | 2 | 3 |
| Film A | 2.5 (−) | 32 (−) | 8 (+) | 4 | 2 | 4 |
| Film B | 13 (+) | 22 (+) | 13 (+) | 9 | 10 | 10 |

(−) = negative static marks
(+) = positive static marks

The reported results show that the film of the present invention always gives positive charges (less dangerous than negative charges which give rise to large branch-like static marks) and substantially no static marks.

EXAMPLE 2

A control x-ray material (Film C) was prepared like Film A of Example 1.

An x-ray material according to the present invention (Film D) was prepared like Film B of Example 1.

An x-ray material according to the present invention (Film E) was then prepared like Film B of Example 1, but containing in each protective layer, per each gram of gelatin, 0.027 g of Tergitol TM NPX, 0.007 of Compound 1, 0.044 g of PMMA of Example 1 and 0.32 g of Ludox AM ®, manufactured by DuPont (a colloidal silica having mean particle sizes of 0.012 μm).

Samples of the three films were processed for 15 hours at 50° C.

After having conditioned the samples at 21° C. and 25% RH for 15 hours, the charging amount and the occurrence of static marks generated on these samples of photographic films were measured in the following manner.

(a) Measurements of generated static marks

Samples having the dimensions of 3.5×29 cm and 7.9×24 cm were cut from the films above and conditioned at 25% RH and 21° C. for 15 hours under suitable safelight conditions. The samples were then evaluated for electrical properties by passing them between rollers made of different materials. In a slow test, the samples measuring 7.9×24 cm were passed between opposed steel and rubber rollers. The fixed steel roller had a diameter of 13 cm and was driven at a variable speed by an electric motor. The opposed rubber roller had a diameter of 2.4 cm and was held in position, against the steel roller, by a 3 Kg counterweight. The steel roller was driven at such a speed that the film velocity was 10 m/min. In a fast test, the steel roller was substituted by a fixed rubber covered steel roller having a diameter of 13 cm. The opposed steel roller had a diameter of 2.4 cm and was held in position by a 3 Kg counterweight. The film velocity was 300 m/min. Each sample of film was passed three times between the rollers and processed in a standard 90" process for X-ray films. The amount of static marking was evaluated using a scholastic rating scale wherein 8 is good (no static marks generated), 1 is bad (static marks on the entire surface) and intermediate values represent intermediate situations.

(b) Measurement of charging amount

In order to measure charging amount generated when the film comes in contact with different materials, each sample 3.5 cm wide was fixed on the surface of a polytetrafluoroethylene resin having a diameter of 13 cm Rollers of different materials (rubber, steel and a roller covered with a standard X-ray intensifying screen) measuring 2.4 cm in diameter were brought into contact with the sample by means of a 1 Kg counterweight. The velocity of the film was 10 m/min. The charge generated was measured with an electrometer placed 1 cm from the surface of the film as the peak value measured during the time interval of 30" starting from zero velocity.

the following Table 3 reports the results of the samples corresponding to the films.

TABLE 3

| | Static marks | | Charging amount | |
|---|---|---|---|---|
| | Slow test | Quick test | (a) | (b) |
| Film C | 2 (−) | 8 | −5.5 | +1.5 |
| Film D | 7 (+) | 5.5 (+) | +4.8 | +1.5 |

TABLE 3-continued

| | Static marks | | Charging amount | |
|---|---|---|---|---|
| | Slow test | Quick test | (a) | (b) |
| Film E | 7 (+) | 6.5 (+) | +3.8 | +2.7 |

(+) = positive static marks
(−) = negative static marks
(a) = rubber roller
(b) = steel roller

We claim:

1. A light-sensitive photographic material comprising a support base and one or more hydrophilic colloidal layers, at least one of which is a silver halide emulsion layer, at least one hydrophilic colloidal surface layer of said material containing (a) a non-ionic surface active agent having a polyoxyalkylene group, (b) a fluorinated organic salt which is the reaction product of a polyoxyalkylene amine compound with a fluorinated organic acid compound, (c) discrete particles of a water-insoluble matting agent and (d) discrete particles of a water-insoluble surface modifying agent selected from the group consisting of silicone polymer and colloidal silica, wherein said polyoxyalkylene amine is represented by one of the following general formulas:

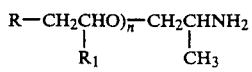

(I)

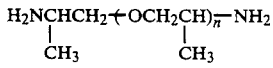

(II)

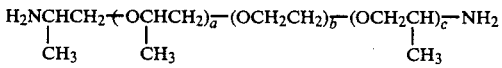

(III)

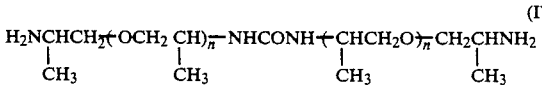

(IV)

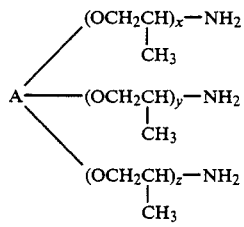

(V)

wherein R represents an alkoxy group which may be substituted, $R_1$ represents a hydrogen atom or a methyl group, n represents an integer of 1 to 50, b represents an integer of 5 to 150, a+c represents an integer from 2 to 5, A represents a CH≡, $CH_3C$≡, $CH_3CH_2C$≡ or a —$CH_2$—CH—$CH_2$—group and x, y and z, equal or different, represent integers of 1 to 30.

2. The light-sensitive photographic material of claim 1, wherein said fluorinated organic acid is represented by the general formula:

$$\{R_f-(B)_o\}-(SO_3H)_p \qquad \text{(VI)}$$

wherein $R_f$ represents an unsubstituted or substituted alkyl group having 2 to 18 carbon atoms or an unsubstituted or substituted alkenyl group having 2 to 15 carbon atoms in which the hydrogen atoms are partially or completely substituted with fluorine atoms to include at least 3 fluorine atoms, B represents a divalent organic group, o represents 0 or 1 and p represents 1 or 2.

3. The light-sensitive photographic material of claim 1, wherein said non-ionic surface active agent is represented by the general formula:

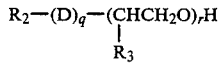

(VII)

wherein $R_2$ represents an unsubstituted or substituted alkyl group having 1 to 30 carbon atoms, an unsubstituted or substituted alkenyl group having 1 to 30 carbon atoms or an unsubstituted or substituted aryl group, $R_3$ represents a hydrogen atom or a methyl group, D represents a group —O—, —S—, —COO—,

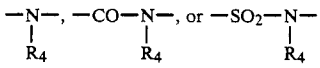

wherein $R_4$ represents a hydrogen atom or an unsubstituted or substituted alkyl group having 1 to 20 carbon atoms, q represents 0 or 1 and r represents an integer of 2 to 50.

4. The light-sensitive photographic material of claim 1, wherein said matting agent has particle mean sizes from 2 to 6 μm.

5. The light-sensitive photographic material of claim 1, wherein said matting agent is polymethylmethacrylate.

6. The light-sensitive photographic material of claim 1, wherein said surface modifying agent has particle mean sizes from 0.001 to 1 μm.

7. The light-sensitive photographic material of claim 1, wherein said silicone polymer has the general formula:

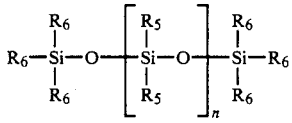

(VIII)

wherein $R_5$ is an alkyl group having 1 to 3 carbon atoms, R6 is an alkyl group having 1 to 3 carbon atoms or an alkoxy group having 1 to 2 carbon atoms and n is a positive integer from 0 to 2000.

8. The light-sensitive photographic material of claim 1, wherein said non-ionic surface active agent is used in a quantity from 10 to 1000 mg/$m^2$ of photographic material.

9. The light-sensitive photographic material of claim 1, wherein said fluorinated salt is used in a quantity from 0.5 to 1000 mg/$m^2$ of photographic material.

10. The light-sensitive photographic material of claim 1, wherein said matting agent is used in a quantity from 5 to 2000 mg/$m^2$ of photographic material.

11. The light-sensitive photographic material of claim 1, wherein said surface modifying agent is used in a quantity from 5 to 5000 mg/$m^2$ of photographic material.

12. The light-sensitive photographic material of claim 1, wherein the hydrophilic colloid of said hydrophilic colloidal layer is gelatin.

13. The light-sensitive photographic material of claim 1, wherein said surface hydrophilic colloidal layer is a protective layer.

14. The light-sensitive photographic material of claim 1, wherein said at least one hydrophilic colloidal layer is a backing layer.

15. A light-sensitive photographic material comprising:

(a) a support base, (b) at least one hydrophilic colloidal silver halide emulsion layer coated on both sides of said support base, and (c) a hydrophilic colloidal protective layer coated on each emulsion layer, wherein at least one hydrophilic colloidal protective layer comprises (a) a non-ionic surface active agent having a polyoxyalkylene group, (b) a fluorinated organic salt which is the reaction product of a polyoxyalkylene amine compound with a fluorinated organic acid compound, (c) discrete particles of a water-insoluble matting agent and (d) discrete particles of a water-insoluble surface modifying agent selected in the group of a silicone polymer and colloidal silica, as defined in claim 1.

* * * * *